US007334384B2

(12) United States Patent
Nissen

(10) Patent No.: US 7,334,384 B2
(45) Date of Patent: Feb. 26, 2008

(54) METHOD AND A SYSTEM FOR PACKAGING OBJECTS IN TUBULAR FILM

(75) Inventor: Per Nissen, Esbjerg (DK)

(73) Assignee: Seelen A/S, Esbjerg (DK)

( * ) Notice: Subject to any disclaimer, the term of this patent is extended or adjusted under 35 U.S.C. 154(b) by 35 days.

(21) Appl. No.: 10/560,729

(22) PCT Filed: Jun. 21, 2004

(86) PCT No.: PCT/DK2004/000438

§ 371 (c)(1),
(2), (4) Date: Dec. 14, 2005

(87) PCT Pub. No.: WO2004/113173

PCT Pub. Date: Dec. 29, 2004

(65) Prior Publication Data

US 2007/0095022 A1 May 3, 2007

(30) Foreign Application Priority Data

Jun. 20, 2003 (DK) ..... 2003 00934

(51) Int. Cl.
*B65B 43/26* (2006.01)

(52) U.S. Cl. ..... 53/459; 53/455; 53/570; 53/576

(58) Field of Classification Search ..... 53/455, 53/459, 465, 469, 570, 576, 577, 578, 579
See application file for complete search history.

(56) References Cited

U.S. PATENT DOCUMENTS 3,461,640 A 8/1969 Bonami
3,798,872 A 3/1974 Cherio et al.
4,050,219 A 9/1977 Higgins
5,467,576 A 11/1995 Hendriks
6,161,365 A 12/2000 Girard et al.
6,298,636 B1 * 10/2001 Lachenmeier et al. ..... 53/459
2003/0154693 A1 * 8/2003 Hannen et al. ..... 53/459
2003/0205035 A1 11/2003 Bussey, Jr. et al.
2006/0053750 A1 * 3/2006 Petersen ..... 53/459

FOREIGN PATENT DOCUMENTS

DE 27 06 955 8/1978
DE 31 01 310 12/1981
EP 0 344 815 12/1989
EP 0 652 156 5/1995
FR 2 747 365 10/1997

* cited by examiner

*Primary Examiner*—Louis Huynh
(74) *Attorney, Agent, or Firm*—Day Pitney LLP

(57) ABSTRACT

A method and system for packaging an object in tubular plastic film, wherein the tubular film is prepared with a number of wrinkle-shaped folds, the film is then processed to bag-shape by welding the film and cutting the welded film from the remaining part of the tubular film, the bag-shaped film with folds is then transferred onto a stationary dispenser device to receive the object, the object is then moved out of the stationary dispenser device into the bag-shaped film and gradually pulls the bag-shaped film off the stationary dispenser device.

11 Claims, 15 Drawing Sheets

METHOD AND A SYSTEM FOR PACKAGING OBJECTS IN TUBULAR FILM

This application is a U.S. National phase application of International Application Number PCT/DK2004/000438 filed on Jun. 21, 2004 and the International Application Number PCT/DK2004/000438 claims priority to Danish Patent Application DK2003-00934 filed on Jun. 20, 2003, which the applications are incorporated hereinto by reference.

FIELD OF THE INVENTION

The invention relates to a method and a system for packaging at least one object in a film, wherein the film is tubular and preferably made of plastics.

BACKGROUND OF THE INVENTION

It is already known to package objects, including compressible objects, by completely or partially manual operations, wherein the objects are introduced into a pre-manufactured, bag-shaped plastics film, ie a bag, prior to packaging. In some cases the bag-shaped plastics films can be advanced automatically to the operator from a stack; and likewise the objects may be advanced to the site of packaging by means of belt conveyors etc. Manual operations are cost-intensive and likewise the capacity—even that of automatic auxiliary equipment—is limited. The latter means ia that the execution of the operations becomes very space-intensive. The manual handling of the bags can be replaced by an automated handling only with difficulty since it is difficult to detect corners, rims and edges accurately to enable accurate seizure of the bags. Unless the bags are seized accurately there is a risk of them being damaged during the handling procedure.

SUMMARY OF THE INVENTION

It is an object of the invention to provide a method and a packaging system, whereby the space-consumption is minimised and that can be exercised automatically. It is a further object to be able to replace pre-manufactured bags and to enable in-situ preparation thereof in connection with the packaging instead. Other objects will become apparent from the specification and the claims.

Novel aspects of the method according to the invention comprises that a piece of the film is seized from a first free end and a number of wrinkle-shaped folds are formed, following which the piece is processed to bag-shape by welding of the film transversally of its longitudinal direction for forming an at least partially closed end and cutting it off the remaining part of the film, following which the bag-shaped film with folds is arranged for receiving the object, following which the object is introduced interiorly of the film and is moved towards the closed end of the film, which movement is performed in such a manner that the film is gradually released and the folds are straightened and the object is at least partially packaged. On the basis of these aspects it is accomplished ia that the consumption of space is minimised since, due to having folds, the film will occupy very little space. Not until the objects are introduced into the film, the film is pulled to its actual length, a procedure that need not occupy much space, since the unfolding may occur in a place where there has to be space available for the object anyway, eg on a roller or belt conveyor that is to move wrapped objects, eg for transportation to storage. Such roller or belt conveyor may be arranged eg underneath the holder means, whereby execution of the operations is enabled in different levels, meaning that no additional space on the floor is occupied. It is also accomplished that the film can be processed to bag-shape in connection with the wrapping.

Conveniently the method involves that the film comprises a first end which is preferably perpendicular to the longitudinal axis of the film, and wherein the method comprises at least use of means for handling the film, an elongate holder device configured for a piece of film being arranged, at least two seizer elements adapted for cooperating with each other for seizing and handling film, means for welding and cutting off the film and a dispenser unit configured for receiving and dispensing, respectively, a prepared piece of film, and means for moving the object through the interior of the dispenser device, said seizer elements being configured for receiving and folding a piece of film, and wherein the method comprises that:

- the film is arranged to enshroud the holder device and with its first end at a first end of the holder device, wherein the first end of the film is seized with the seizer elements;
- following which the seizer elements are moved essentially longitudinally of the holder device towards its opposite end and completely or partially towards this end in such a manner that the film is arranged in folds on the seizer elements;
- following which the film is secured by the seizer elements and moved from the holder device and across the dispenser device;
- during which movement the folded film is processed to bag-shape on its way, said film being—at a point after the folds and opposite the first end of the film—welded and cut off, whereby a free and at least partially closed end of the film is formed, which closed end is thus arranged opposite the first end of the film;
- following which the seizer elements are released from the film, whereby the folded film is left exteriorly on the dispenser device;
- and following which the object is moved out of the dispenser device towards the closed end of the film and on in such a manner that the film is gradually pulled off the dispenser device and the object is at least partially packaged therein.

Thus the method can be automated without encountering any problems with respect to detection of corners, rims or edges on pre-manufactured bags, the film being shaped in the course of the process.

The method may be intended for packaging compressible objects wherein, following receipt of the film, the dispenser device expands it, whereby the film is caused to shrink around the object when pulled off the dispenser device. Hereby the need for subsequently shrinking the film eg by supply of heat is eliminated; rather it may be caused to tightly enwrap objects or even to compress them for accomplishing a reduction in the volume of the object.

Conveniently the method can be applied for successively packaging a series of objects or a series of portions of objects, wherein the method comprises that, after a piece of film has been folded and processed to bag-shape, a first new end is formed in connection with the cutting off, said cutting off being accomplished in a position between the holder means and the dispenser device. Hereby the method is further suitable for automated exercise, the remaining film being, following the cutting off procedure, arranged in the same manner as the film just configured. More conveniently the method may comprise that the remaining film is pulled back across the holder means, whereby the new first end of the film is arranged at the first end of the holder means. Hereby the first end can be seized very accurately since the holder means supporting and carrying the film constitute at least some fixation points for the arrangement of the film.

Even further conveniently the first end of the film can be closed following packaging of the object, which closing operation preferably comprises tightening by string or welding. Hereby the object or objects is/are packaged in a completely closed packaging.

A further aspect of the invention relates to a system for exercising one or more of the afore-mentioned methods, wherein the system comprises means for handling tubular film, an elongate holder device configured for a piece of film being arranged, at least two seizer elements adapted for cooperating with each other for seizing and handling film, means for welding and cutting off film, and a dispenser device configured for receiving and dispensing, respectively, a prepared piece of film, and means for moving the object through the interior of the dispenser device, said seizer elements being arranged for receiving and folding a piece of film, wherein the system is configured for a piece of film to be configured with a number of folds and processed to bag-shape which is suitable for being arranged on the dispenser device; and wherein the system is configured for objects to be packaged by being moved towards a bottom of the bag-shaped film and gradually on in such a manner that the film will gradually be released from the dispenser device.

According to one embodiment the dispenser device can be configured for being able to expand a piece of film. When the film is subsequently released it will, eg if plastics film is used, contract anew and hence tightly enclose the object being packaged.

According to a preferred embodiment the expanse of the dispenser device is shorter than the object or objects to be wrapped, whereby the space consumption is reduced. The dispenser device may have an expanse that corresponds to that of the film in the folded state thereof, which may be considerably shorter than the expanse of the objects.

According to yet a preferred embodiment the holder means may be journalled on rollers and configured such that the tubular film is able to travel, between the rollers and holder means for enshrouding the holder means. Hereby the film is able to completely enshroud the holder means, whereby the holder means are able to position the film extremely accurately, including in particular when the circumference of the holder means correspond to the circumference of the film, whereby the film is completely expanded.

According to a further preferred embodiment the system may comprise means for storing film on a roller supply and be configured for film to be advanced to the holder means; and wherein the film is tubular either from the beginning or wherein the system is configured for film to be continuously shaped and welded for achieving the tubular configuration during its advancement to the holder means. Hereby a large amount of film may be able for the exercise, whereby the system need eg not stop so often due to shortage of film or halt for exchange. Moreover, film on roller supplies is considerably less expensive in purchase costs than pre-manufactured bags.

Convenient use of a method or a system according to the above may comprise packaging of stacked boards, including gypsum boards, or packaging of insulation material, including preferably wool, mineral wool, glass wool or some other type of fibre-based mineral or organic material.

Yet an aspect of the invention comprises a method of seizing and preparing film for packaging at least one object, which film is essentially tubular and preferably made of plastics, and said film comprising a first end, which end is preferably perpendicular on the longitudinal axis of the film, wherein the method at least comprises use of means for handling the film, an elongate holder device configured for arrangement of a length of film, at least two seizer elements adapted for seizing and handling film, means for welding and cutting off the film and a dispenser device configured for receiving a prepared length of film, wherein each seizer element comprises a storage part configured for receiving an amount of film, a barrier part and a locking means, wherein the method comprises that the film is arranged to enshroud the holder device and with its first end at an end of the holder device, wherein the first end of the film is seized in that the storage parts of the seizer elements are conveyed into the first end of the film and moved essentially longitudinally of the holder device towards the opposite end thereof in such a manner that the film is arranged in folds on the storage parts, the barrier parts blocking the first end of the film following which the folded film is secured on the storage parts in that the locking means will, from the exterior, press the film towards the storage parts, following which the folded film is moved from the holder device and across the dispenser device, during which movement the film is welded and cut off, whereby a free closed end is formed on the folded film, following which the locking means and the storage parts are released from the film, whereby the folded film is left on the dispenser device.

Yet a further aspect may comprise that, when a method according to the invention is exercised, seizer elements are used that each comprises a storage part, a barrier part and a locking means. According to a preferred embodiment the storage part and the locking means may be configured for being able to rotate independently of each other. According to yet a preferred embodiment the storage part can be essentially cylindrical, while the locking means may be finger-shaped and curved and preferably be provided with a friction-seeking coating for adequate locking of the film.

BRIEF DESCRIPTION OF THE DRAWINGS

In the following the invention will be described in further detail with reference to figures that give exemplary embodiments of the invention.

DETAILED DESCRIPTION OF THE INVENTION

Figure 1:
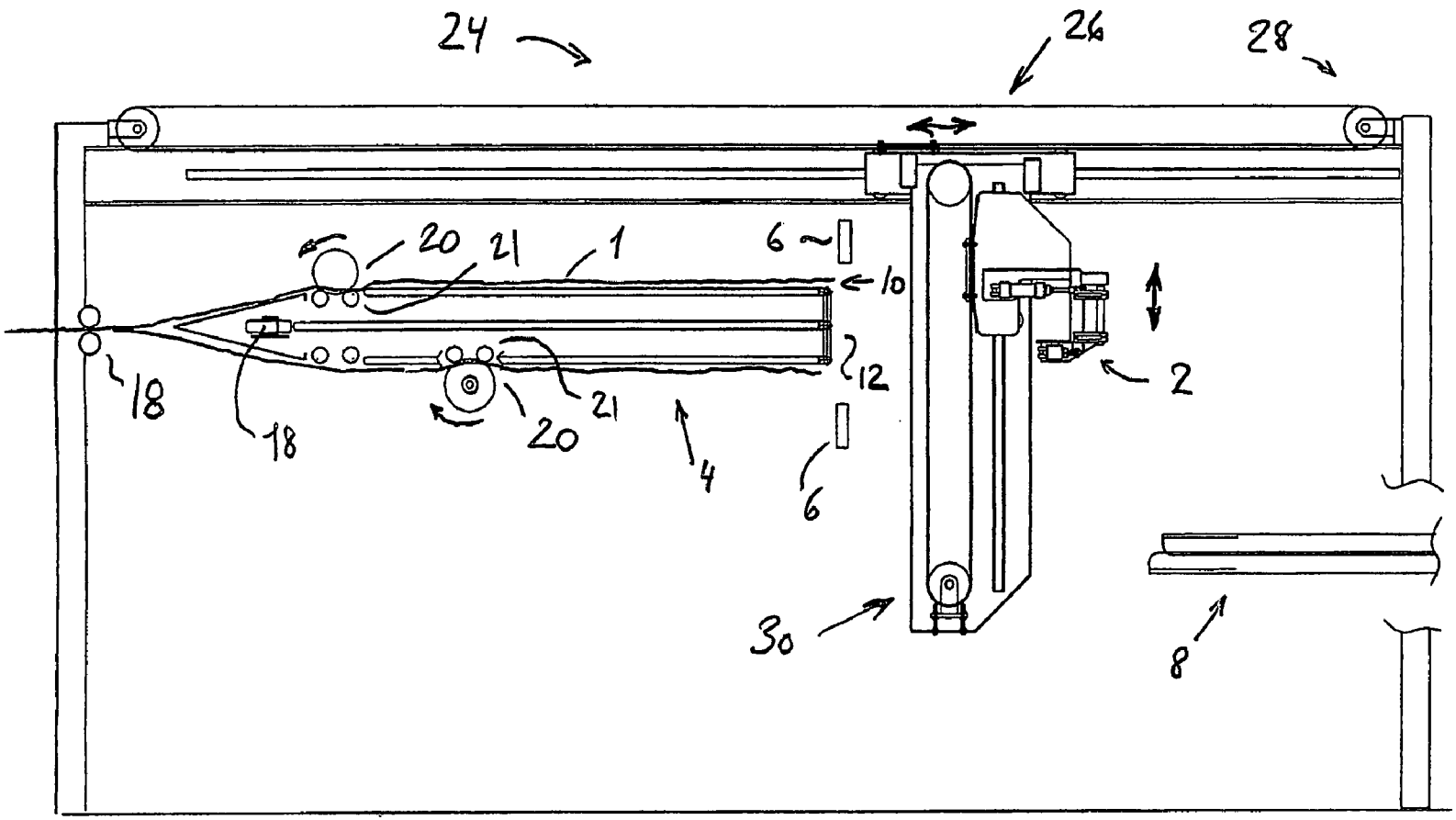
FIGS. 1-4 schematically show a system of packaging, seen from the side—see section A-A shown in FIG. 5.

FIGS. 1-4 shows a system for packaging objects. A portal 24 is a frame construction from which the majority of the remaining system components are suspended. The system comprises guide rollers 18 that convey a tubular film 1 across a holder device 4. The holder device 4 is floatingly suspended by being journalled on rollers 20 that support on other rollers 21 that are connected to the holder device 4. The rollers 20 are driven. The film 1 is conveyed between the rollers 20 and 21, whereby film can be advanced by rotation thereof. Hereby the rollers 20, 21 manage two tasks, viz floating journaling of the holder device and advancement of film. In FIG. 1 the film 1 is conveyed to the end of the holder device 4, whereby the film has its first end 10 arranged at the first end 12 of the holder device. In this position the first end 10 of the film can be positioned very accurately, the holder device 4 being able to suitably expand the film, whereby a well defined location is thus allocated to the rim or the edge of the first end 10 of the film.

Moreover the system comprises a travelling carriage 26 that can be guided on rails and operated by means of a notched belt drive 28 (motor etc not shown). Two levers 30 (only one shown) are connected to the travelling carriage 26 and comprises guides and drives for positioning of two seizer elements 2 (only one seizer element 2 is shown). The system also comprises a dispenser device 8. The travelling carriage 26 moves in the horizontal plane, while the seizer elements 2 on the levers 30 can be moved up and down. Usually the system will also comprise means for horizontal movement of the seizer elements 2 transversally of the direction in which the travelling carriage 26 is moved, whereby full three-dimensional mobility is imparted to the seizer elements 2 on the basis of the combination of the three directions of movement.

Figure 2:
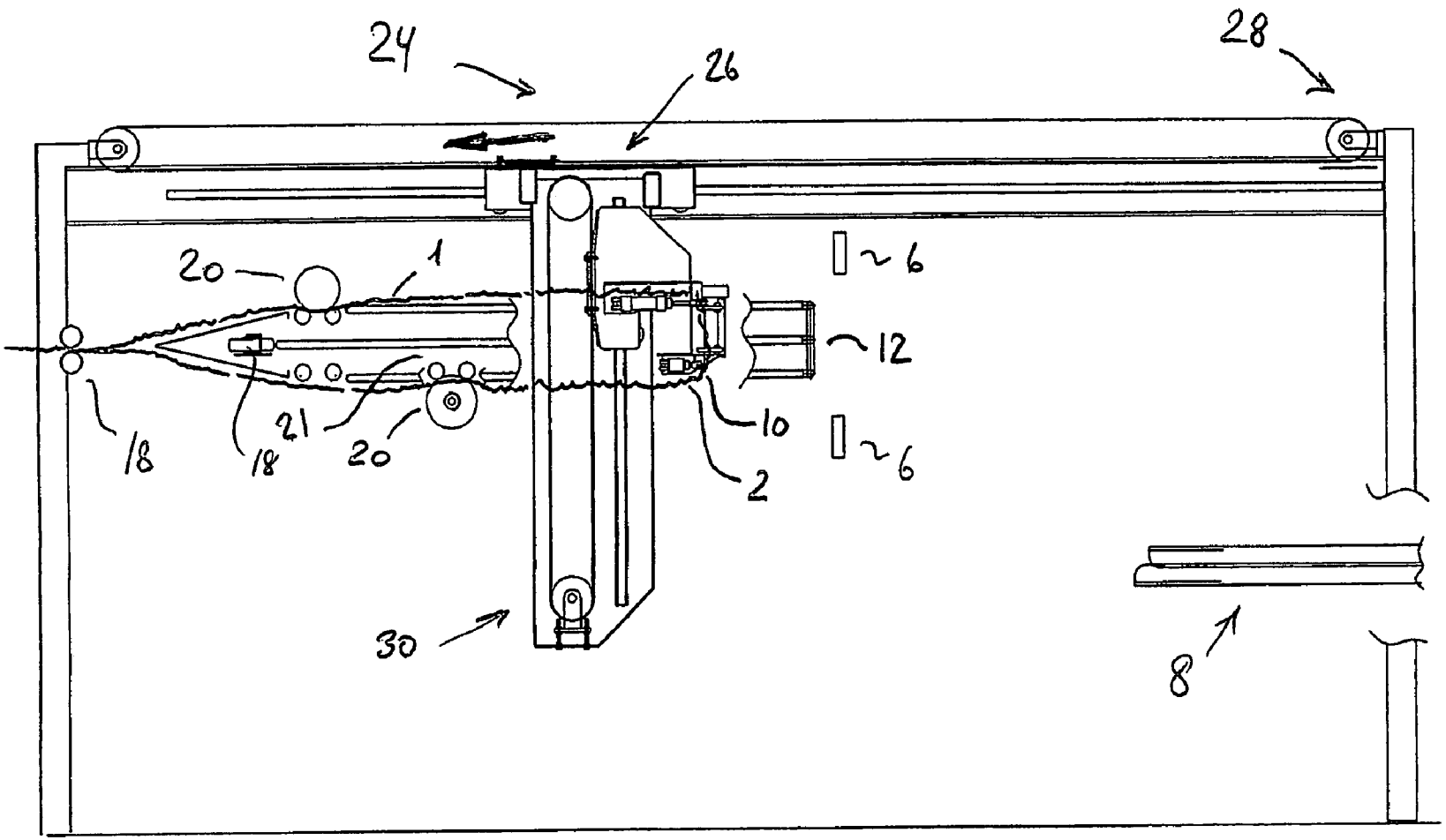
Figure 3:
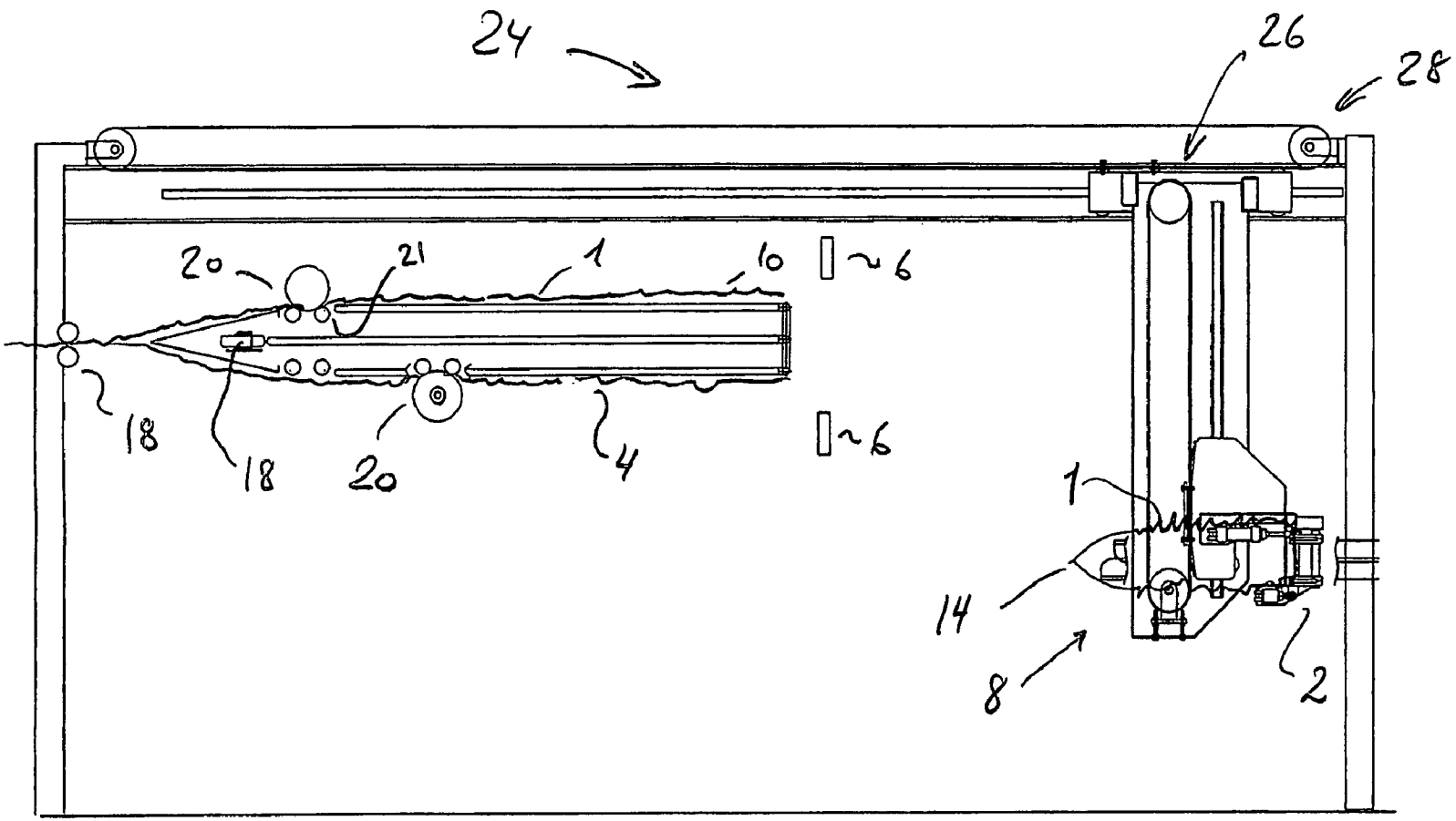

In FIG. 2 the seizer elements 2 have seized the film 1 at the first end 10 thereof and are moved towards that end of the holder device 4 which is opposite the first end 12. The seizer elements 2 are configured in such a manner that the film 1 deposits on the seizer elements 2 in wrinkle-shaped folds. When a sufficient amount of film 1 has settled on the seizer elements 2, the folded film 1 is locked and the seizer elements 2 are conveyed in a direction towards and beyond the first end 12 of the holder device, while simultaneously further film 1 is advanced by means of rollers 20, 21, thereby preventing the film 1 from being torn, and new film is advanced for the subsequent cycle. In the position immediately preceding the first end 12 of the holder device, means 6 are arranged for welding and cutting off (cutting free) the film. The means 6 close around the film 1, weld it together and cut it off to the left of the welding seam and hereby form an at least partially closed end 14 on that part of the film which is situated on the seizer elements 2, whereby the shape of a bag is imparted to the film 1 on the seizer elements. The bag-shaped film 1 is taken by the seizer elements 2 to a dispenser device 8, on which the film 1 is arranged with the closed end 14 at the end of the dispenser device 8. The dispenser device may be a cylinder, two half-shells or other that is able to keep the film 1 expanded and is configured for an object to be packaged to be conveyed through the dispenser device 8 and towards the closed end 14 of the film. By continuing the movement of the object, the object will pull the film 1 off the dispenser device and be enclosed by the film 1 and hence it becomes at least partially packaged. Subsequently the film 1 can be closed entirely around the object. The dispenser device 8 can be configured for expanding the film 1, and objects can thus be packaged in the expanded film that with contract around the objects.

Figure 4:
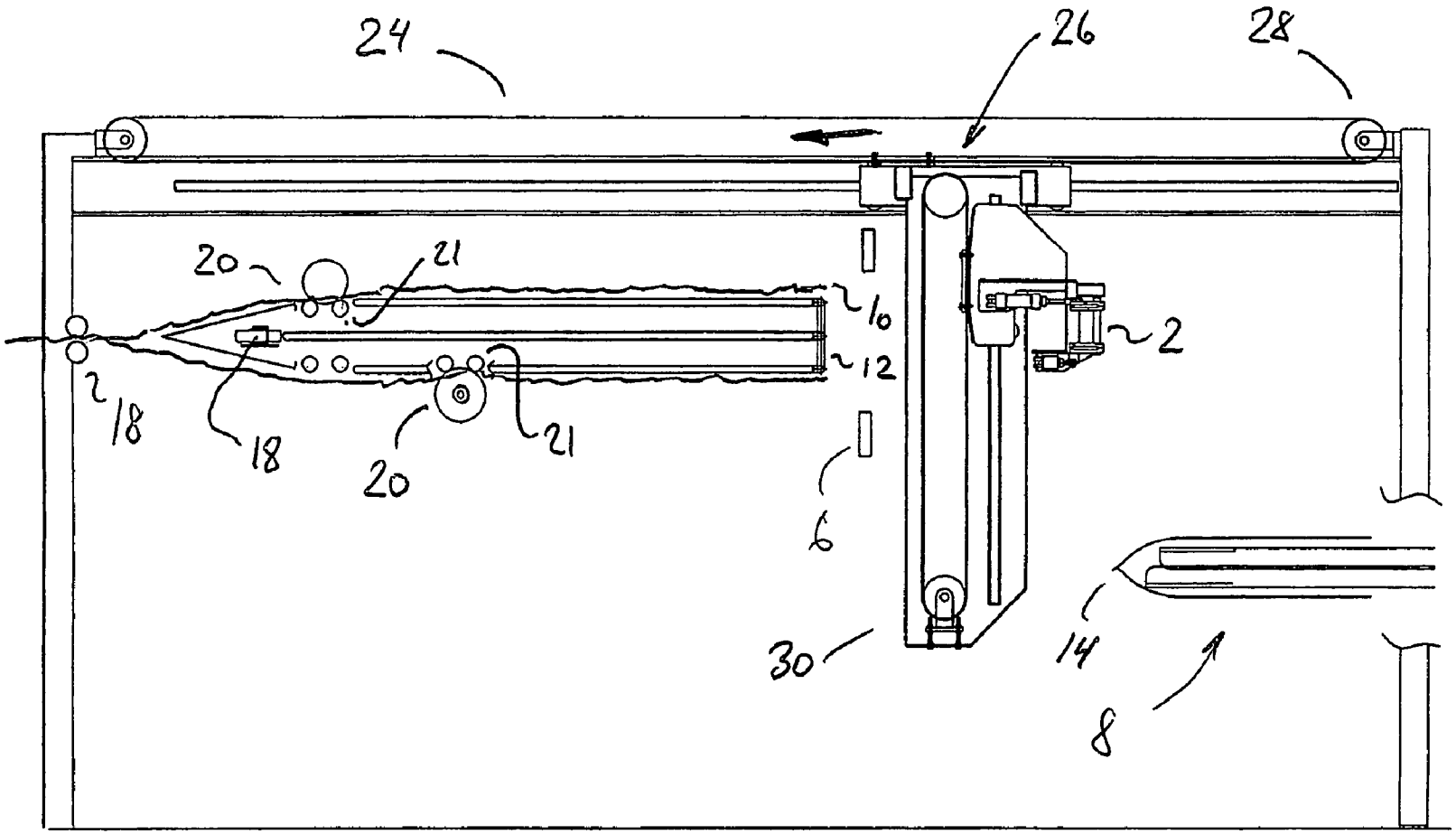

Advantageously the seizer elements 2 can be released from the film 1 when it is arranged on the dispenser device 8, whereby the seizer elements 2 are able to return earlier to the holder device 4 for the subsequent cycle. In FIG. 4, the seizer elements 2 have delivered a piece of bag-shaped film 1 onto a dispenser device and are making their way back to the holder device. The distance between the holder device 4 and the dispenser device 8 will usually be small for the sake of making the expanse of the system the smallest possible. The holder device 4 and the dispenser device 8 can advantageously be arranged in different levels, whereby the space underneath the holder device 4 can be used to advantage for eg a transportation system for receiving packaged objects.

Figure 5:
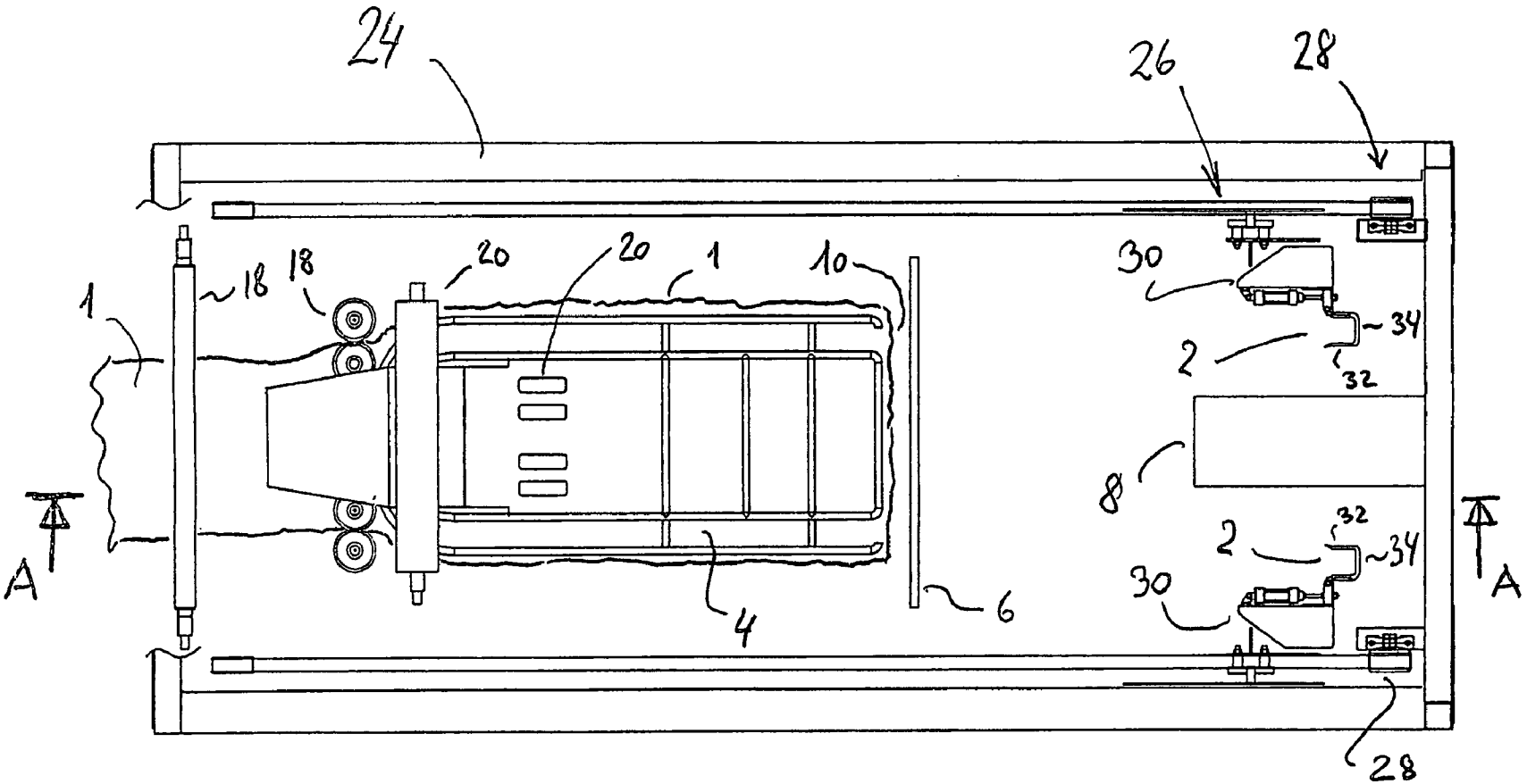
FIG. 5 schematically shows a system of packaging, seen from above.

FIG. 5 shows the system from above, from where it will appear that the portal 24 comprises two parallel paths with notched belt drives 28. The travelling carriage 26 is shown without any transverse connections. The levers 30 are connected to the travelling carriage 26. Seizer elements 2 are connected to the levers 30, said seizer elements 2 each comprising a storage part 32 for receiving film 1 and a barrier part 34 intended for the first end 10 of the film to be in contact therewith and hence be blocked. FIG. 5 does not show means for locking the film on the seizer elements 2. It will appear from the figure that film 1 passes guide rollers 18 and advancement rollers 20 and enshrouds the holder device 4. The film 1 is preferably arranged with its first end 10 close to the end of the holder device 4. After the holder device means 6 are arranged for welding and cutting off film 1. Moreover, the Figure shows a dispenser device 8.

Figure 6:
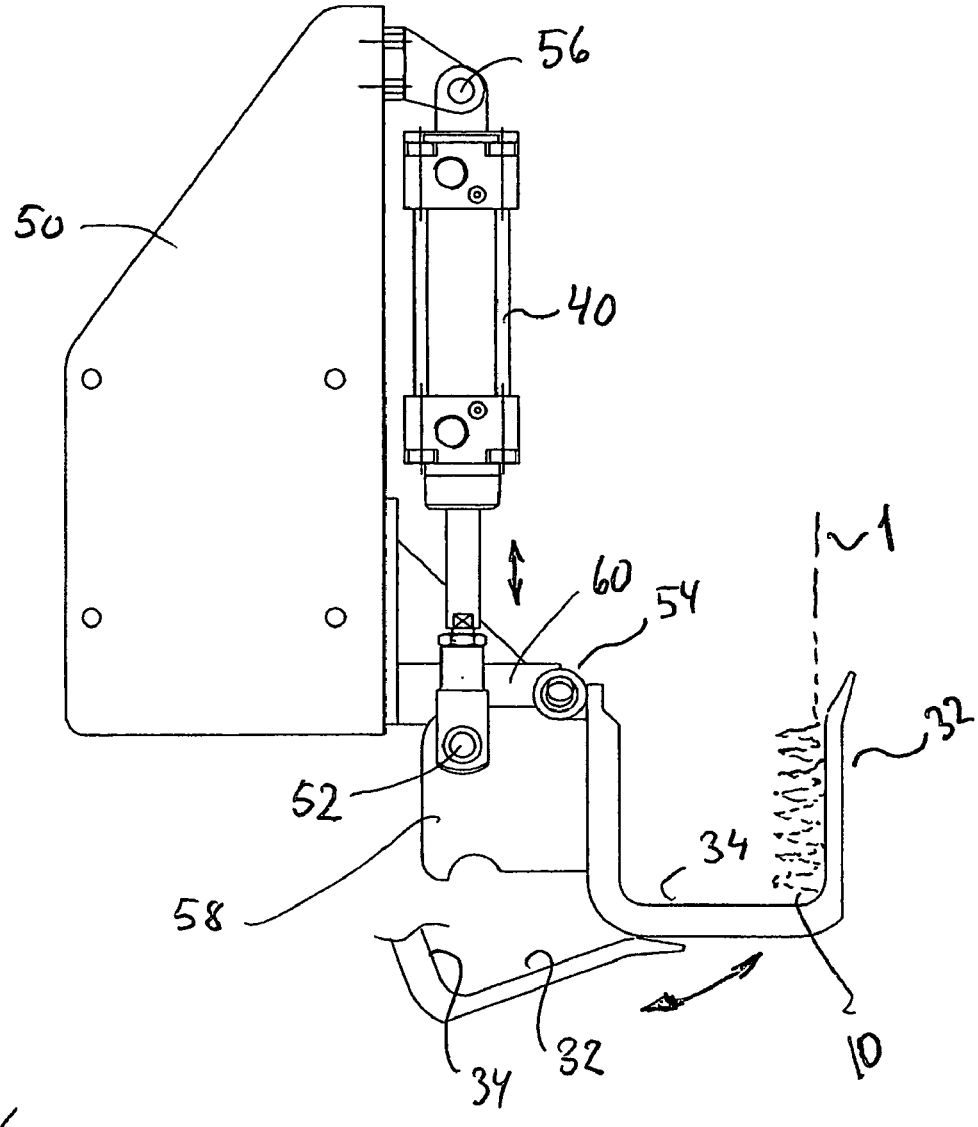
FIGS. 6-7 schematically show details of a seizer element, seen from above.

FIG. 6 shows details of a seizer element 2, means for locking not being shown. At its rear end an actuator 40 is connected to a bracket 50 by means of a rotary fitting 56. Via a bearing 52, the piston rod of the actuator is connected to a plate 58 to which a hook-shaped or U-shaped seizer part is secured and comprising a barrier part 34 and a storage part 32. The storage and barrier parts 32, 34 may be turned by means of the actuator 40, the plate 58 being connected to a bearing 54. Via a bracket 60, the bearing 54 is secured to the bracket 50. The dotted line shows film 1 arranged in folds on the storage part 32 with its first end 10 towards the barrier part 34.

Figure 7:
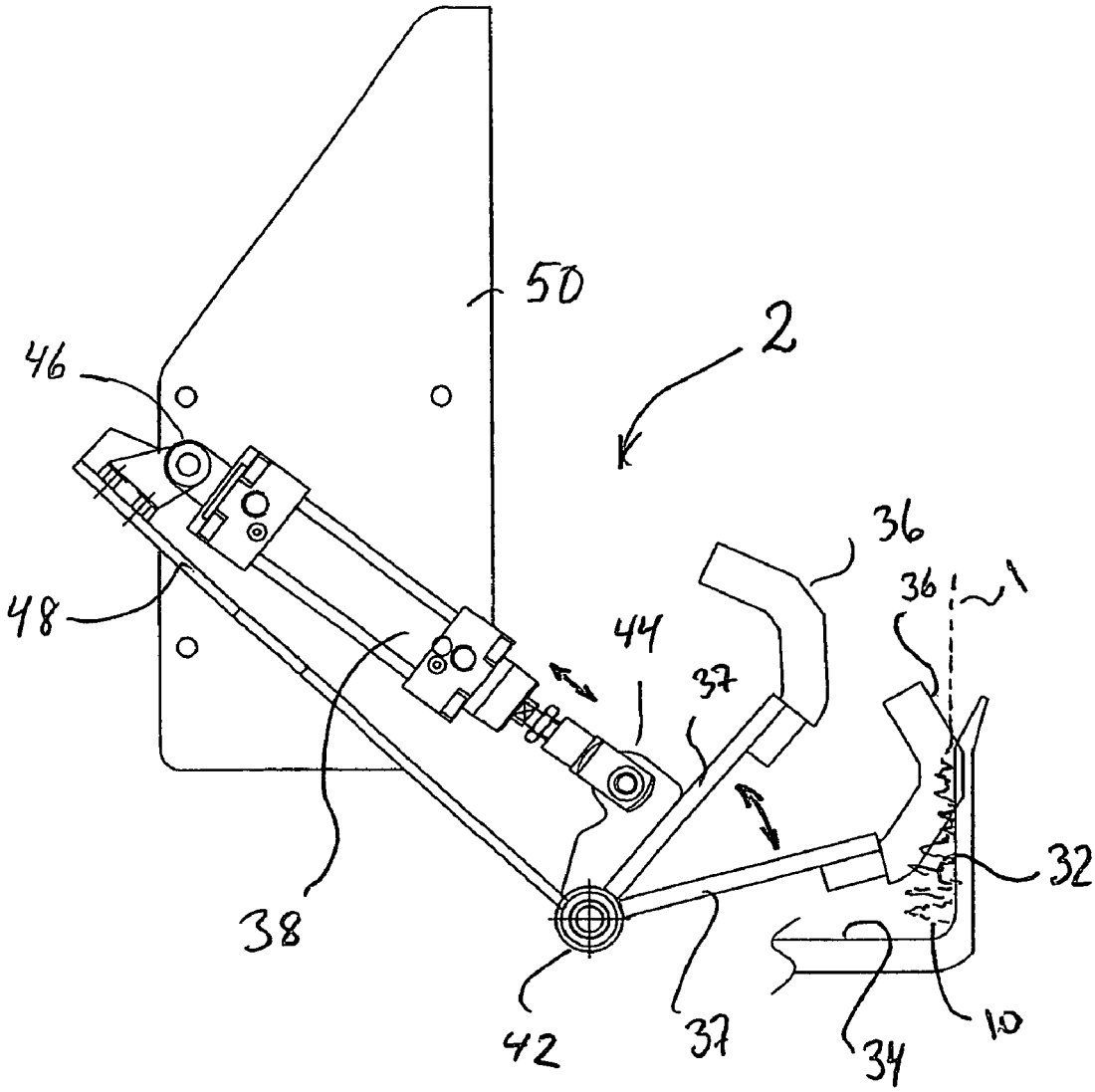

FIG. 7 shows details of a seizer element 2, where a bracket 48 is secured to a bracket 50. At its one end an actuator 38 is secured to the bracket 48 via a rotary fitting 46. At the other end the piston rod of the actuator is turnably secured to a lever 37, which lever 37 is, via a bearing 42, connected to the bracket 48. At its other end the lever 37 is connected to a curved, finger-like locking means 36 which is preferably covered in rubber or provided with other friction-seeking coating for adequate locking of film. Moreover, the Figure schematically shows a storage part 32 and a barrier part 34, wherein an amount of film 1 is arranged. As will appear the lever 37 and the locking means 36 can be moved between two positions for locking and not locking, respectively, the film 1 against the storage part 32.

Figure 8:
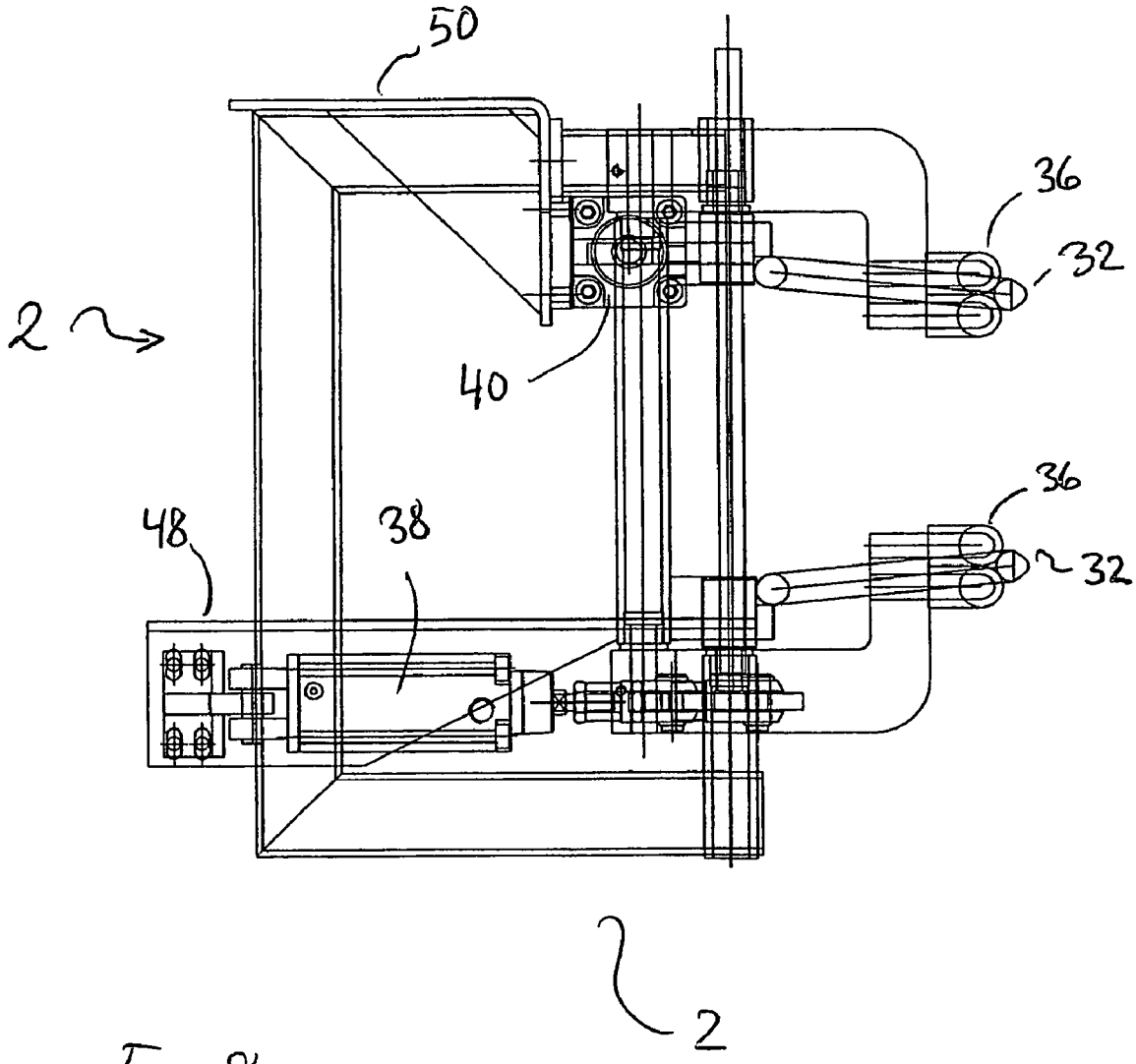
FIGS. 8-9 schematically show details of a seizer element, seen from the side.
Figure 9:
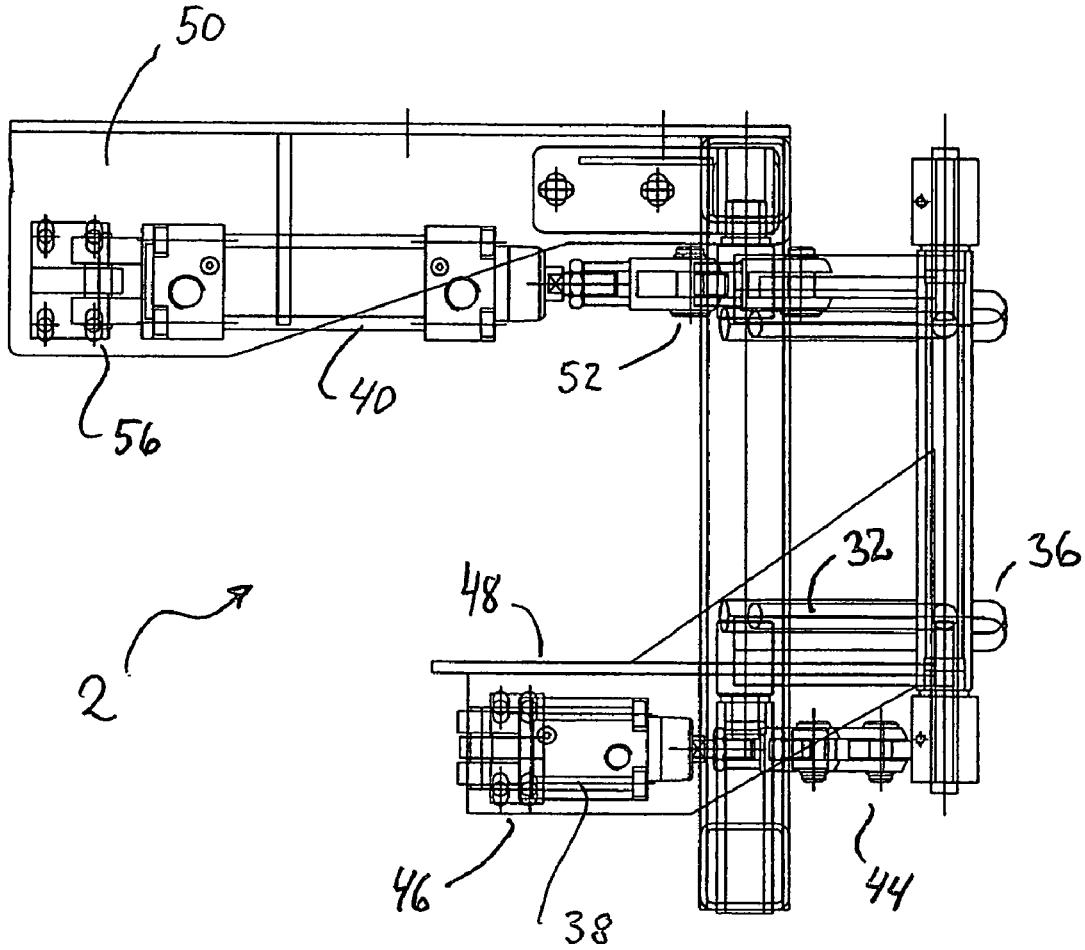

FIGS. 8 and 9 show details of a seizer element 2 corresponding to the teachings of FIGS. 6 and 7 and comprising storage parts 32 and locking means 36 as well as actuators 38 and 40. As will appear, the seizer element 2 is configured with two sets of storage parts 32 and locking means 36, but it is obvious to provide the seizer element 2 with fewer or more storage parts and locking means depending on the task to be performed.

Figure 10:
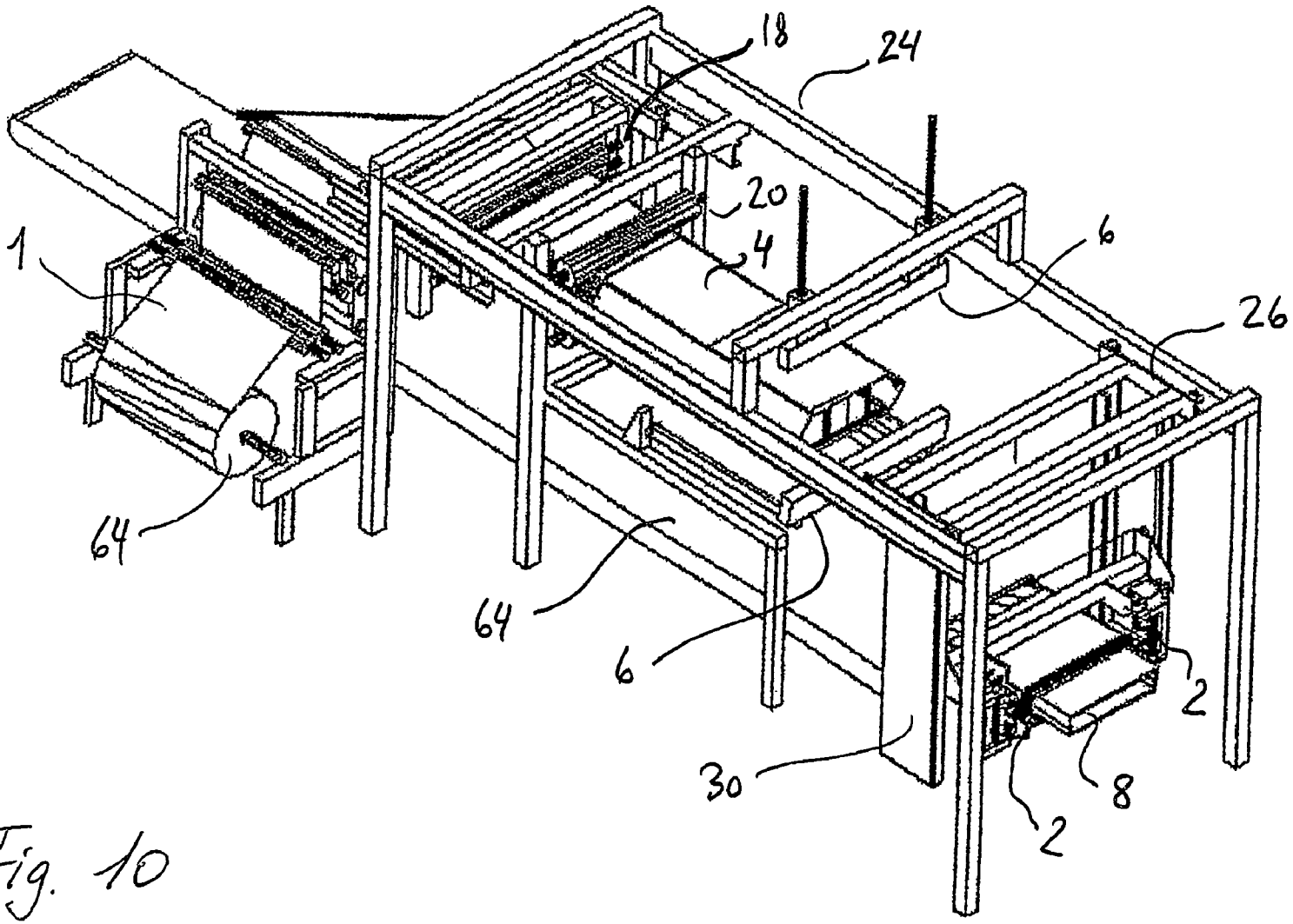
FIG. 10 shows an embodiment of a system, seen in an inclined view from the side and from above.

FIG. 10 shows a system in which film 1 from a roll 64 is conveyed via guide rollers 18 and advancement rollers 20 to a holder device 4. The system comprises a portal 24, on which a travelling carriage 26 travels that has arms 30 on which seizer elements 2 are arranged. Moreover, the system comprises means 6 for welding and cutting off film and a dispenser device 8 for receiving film 1. The figure also shows a conveyor 64 arranged underneath the holder device 4 for transporting packaged objects. The various system components can of course be arranged in many different ways in relation to each other—in response to the nature of the building in which the system is to be employed, the type of objects to be packaged, and soon.

Figure 11:
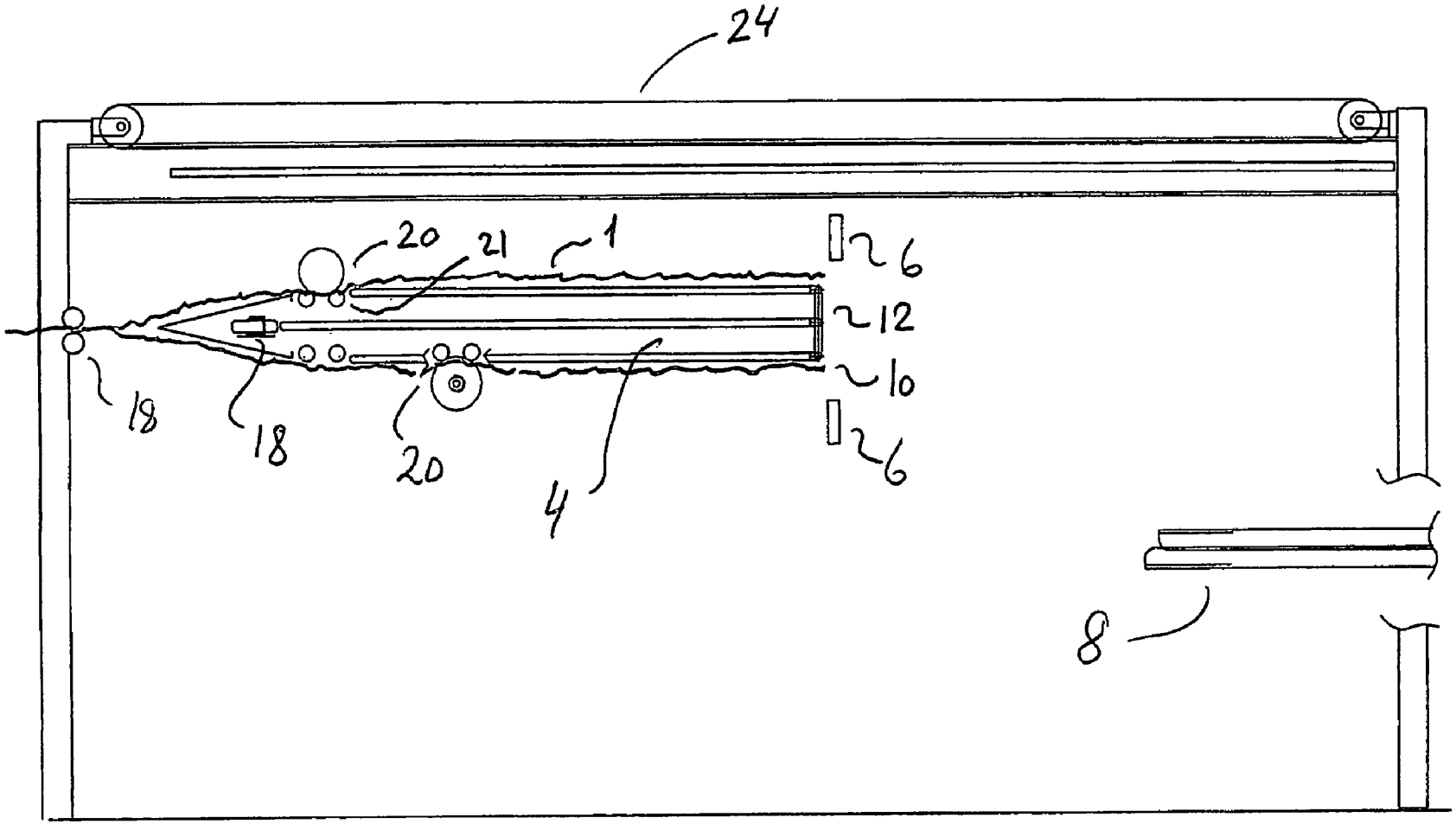
FIGS. 11-15 show stages in the exercise of a method according to the invention. The depiction corresponds to that of FIG. 1, only in a more simplified version.
Figure 12:
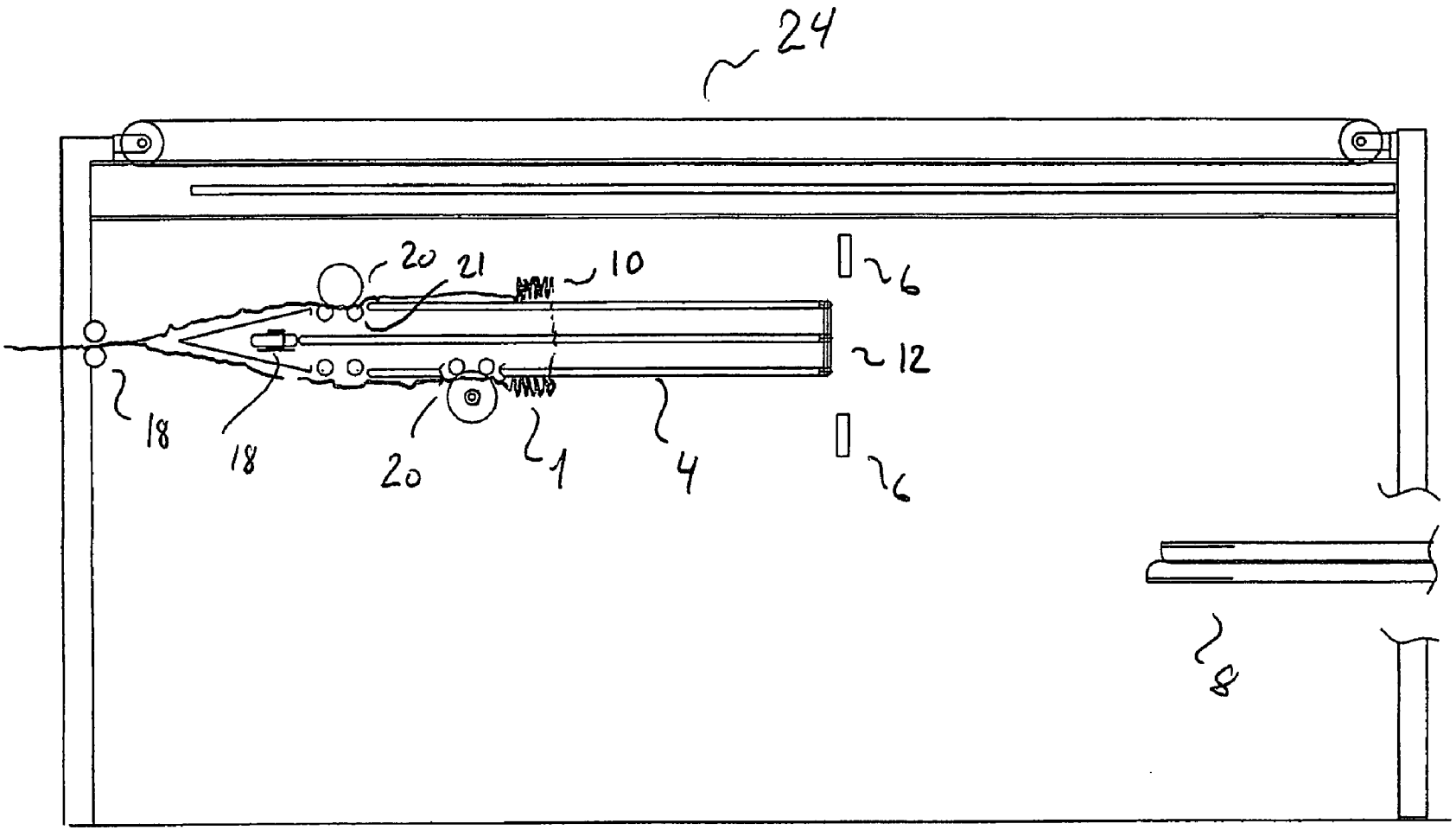

FIGS. 11-15 schematically show the individual steps in a packaging sequence (cycle). Corresponding to FIGS. 1-4, a portal 24 is provided on which a travelling carriage with levers and seizer elements, etc, can travel (not shown) and wherein the remaining components 18, 20, 21, 4, 6, etc, can be suspended. For the sake of overview, this is omitted in the drawing, and likewise it is trivia to the machine constructor. In FIG. 11, a film 1 is advanced across a holder device 4 via guide rollers 18 and advancement rollers 20, 21. The first end 10 of the film is arranged at the first end 12 of the holder device. In that position the film 1 is seized by not shown seizer elements. FIG. 12 shows how the film 1 is taken in a direction opposite the first end 12 of the holder device and is arranged in folds. Usually the folds will be arranged on a storage part 32 by seizer elements 2 as shown eg in FIGS. 6 and 7. When a desired piece of film 1 is arranged, the folded film 1 is locked, eg by a locking means as shown in FIG. 7.

Figure 13:
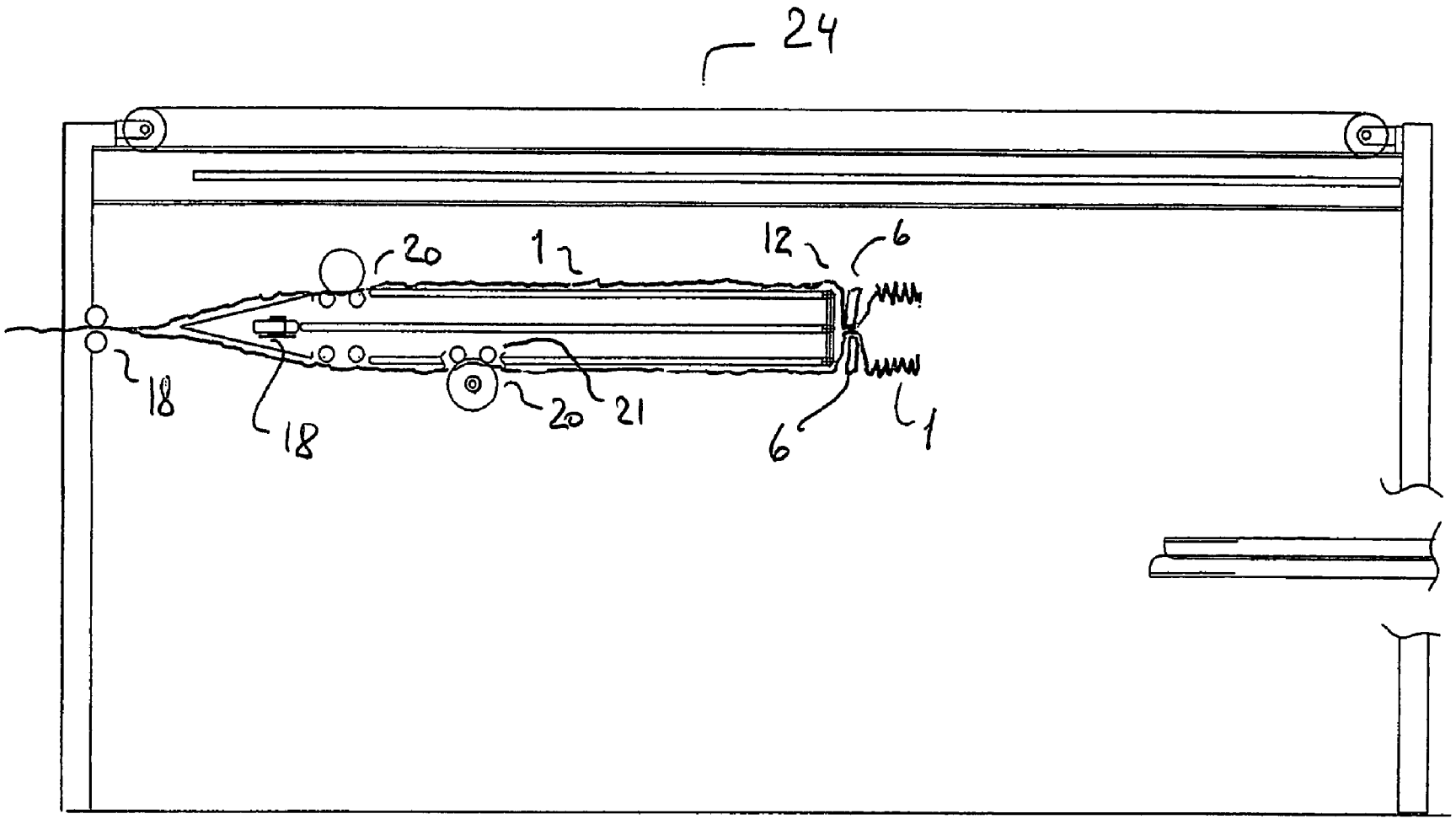
Figure 14:
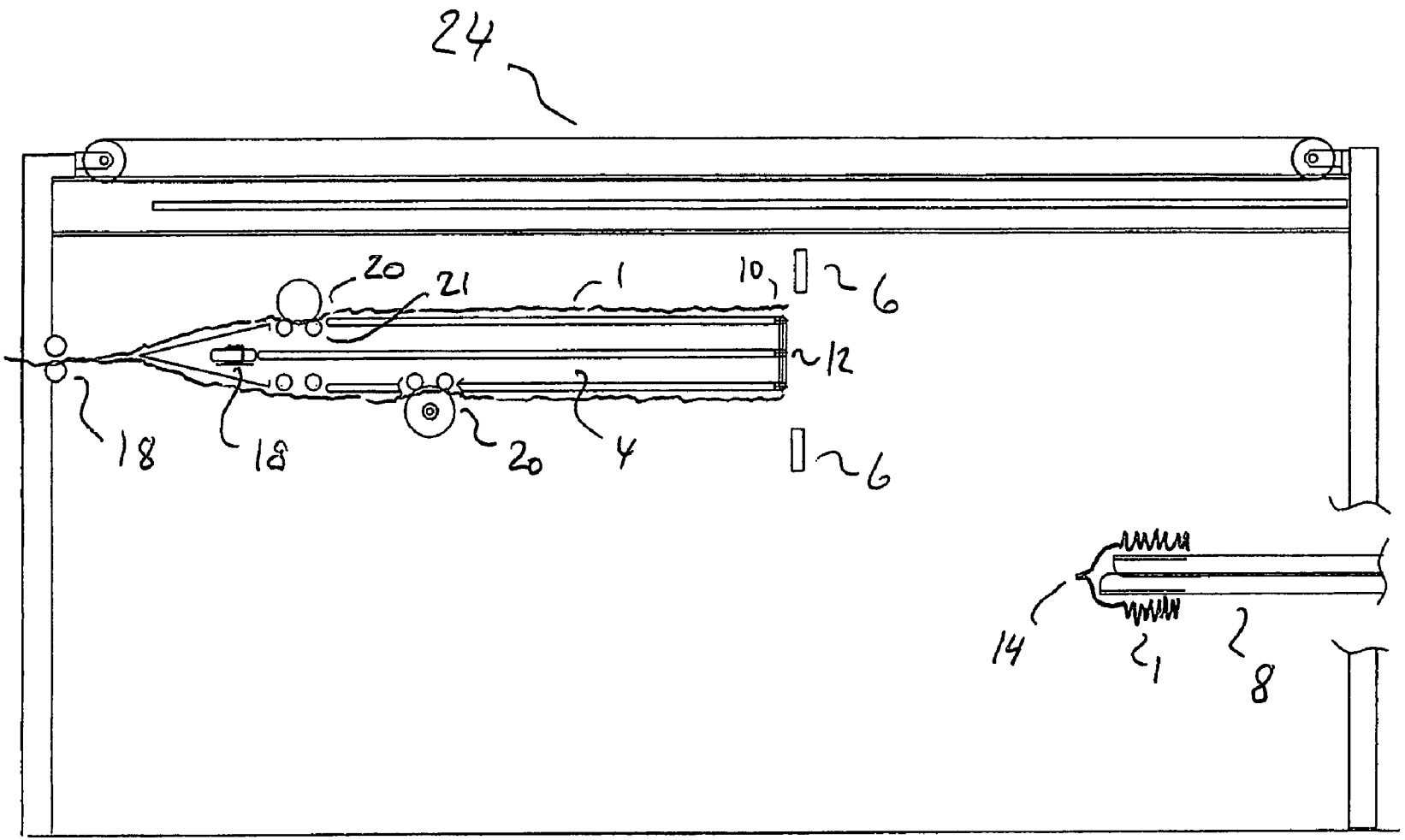

Then the folded film 1 is moved beyond the end 12 of the holder device 4 as shown in FIG. 13, while simultaneously further film 1 is trained along for use in the subsequent cycle. The film 1 is joined by welding and cut off by the means 6. The welding and cutting off taking place before the end 12, the new first end of the film 1 is caused to be a distance before the end 12. This involves a risk that it hangs down or closes in whereby it becomes difficult to seize the film 1 accurately. To avoid this, the film 1 can be pulled a distance back, eg by means of the rollers 20, thereby enabling that the new end of the film is arranged at the end 12 of the holder device. Thereby it is possible to seize it more accurately. FIG. 14 shows how the film 1 is withdrawn to the effect that the end 10 is arranged flush with the end 12 of the holder device 4.

Moreover, FIG. 14 shows that the folded film 1 is conveyed to a dispenser device 8 on which it is arranged with its closed end 14 (configured by welding and cutting off, see FIG. 13) at the end of the dispenser device 8. Movement of the film 1 from the holder device 4 to the dispenser device 8 is accomplished by means of not shown seizer elements, eg as shown and described in relation to FIGS. 1-5. The film 1 is let go by the not shown seizer element as indicated in FIG. 6, the storage part 32 being rotated to let go of its engagement. This could also be accomplished in some other manner, eg by displacement of the storage part 32 towards the centre axis of the tubular shape of the film and then away in a direction away from the end 10 of the film.

Figure 15:
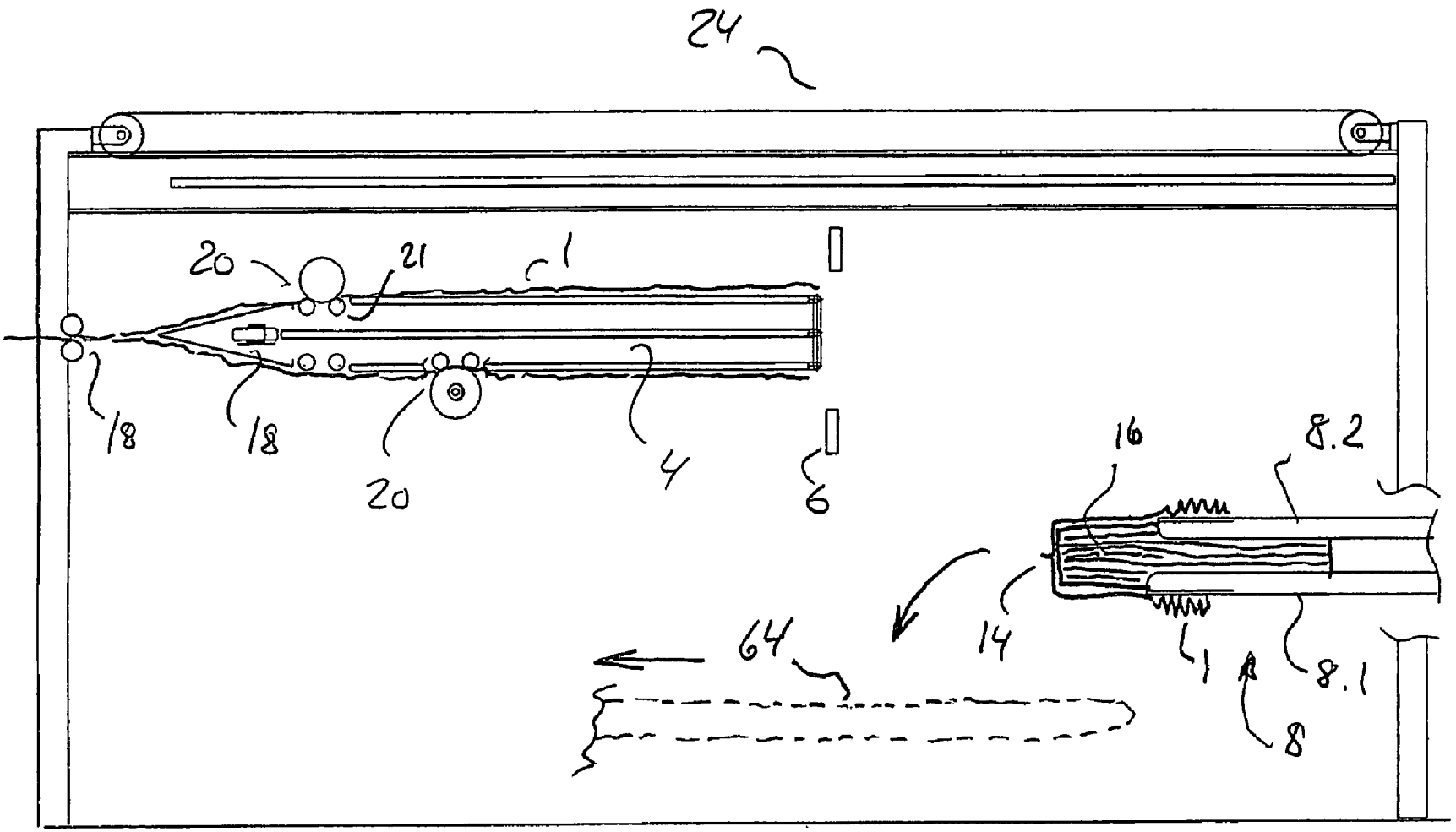

FIG. 15 shows an embodiment in which the dispenser device 8 comprises to halves 8.1 and 8.2 that are configured for expanding the film 1 by being moved away from each other. An object 16, eg a stack of gypsum boards, is conveyed through the dispenser device 8, eg by being pushed by means of a piston or by means of a conveyor, belt or roller path towards the closed end 14 of the film. This movement is continued in such a manner that the film is gradually released and encloses the object 16. When the object 16 has travelled entirely through it is fully packaged, except that the film is not closed; however, that can be accomplished by a subsequent tightening by string, etc. The packaged object 16 can then be taken away, eg by means of a conveyor 64 outlined by dotted line. The conveyor 64 can be arranged underneath the holder device 4 for using the floor space to advantage. The conveyor 64 can also be arranged in level with the dispenser device 8, including eg to assist in pulling the object 16 out during the packaging. The dispenser device 8 may comprise various pieces of auxiliary equipment for controlled release of the folded film 1. As will appear the system becomes extremely compact, the film 1 having in the folded state a very limited expanse. Besides, the dispenser device 8 may be made with a very short length as it has to be able to receive the film 1 in its folded length only.

If desired, the dispenser device 8 can be arranged below the holder device 4 to occupy as little space as possible. All it takes is space enough for the folded film 1 to be taken to the end of the dispenser device 8 between this and the holder device 4. Alternatively the seizer elements 2 can be configured to be able to rotate about a common horizontal axis, whereby the closed end 14 of the film can be turned 180°. In that case the dispenser device 8 can be arranged below the holder device 4, and the packaging of the objects 16 can be accomplished in a direction opposite the one shown in FIG. 15.

It is to be understood that the invention as disclosed in the present specification and figures can be modified or changed and yet remain to be comprised by the protective scope as defined by the following patent claims.

The invention claimed is:

1. A method of packaging at least one object (16) in film (1), which film (1) is tubular and made of plastics, wherein the method comprises that a piece of the film (1) is seized from a first free end, and a number of wrinkle-shaped folds are formed, the film is then processed to bag-shape by welding the film (1) transversally with respect to a feeding direction of the tubular film for forming an at least partially closed end (14), and cutting the piece of film processed to bag-shape off the remaining part of the film, and the bag-shaped film with folds is arranged to receive the object (16), characterized by, that said bag-shaped film is transferred to a stationary dispenser device (8) on which the film (1) is arranged and the bag-shaped film (1) is left exteriorly on the dispenser device (8), whereby the object (16) is moved out of said dispenser device (8) towards the closed end (14) of the film in such a manner that the film (1) is gradually pulled off the dispenser device (8) and the object (16) is at least partially packaged therein, wherein after leaving the bag-shaped film (1) on the dispenser device (8) a subsequent bag-shaped film is prepared for a subsequent object.

2. A method according to claim 1, wherein the film (1) comprises a first end (10) which is perpendicular to the feeding direction of the film (1), and wherein the method at least comprises use of means for handling the film, an elongate holder device (4) configured for arranging a piece of film (1), at least two seizer elements (2) adapted for cooperating with each other for seizing and handling film (1), means for welding and cutting (6) off the film and said dispenser device (8) configured for receiving and dispensing, respectively, a prepared piece of film (1), and means for moving the object interiorly through the dispenser device, said seizer elements (2) being configured for receiving and folding a piece of film, and wherein the method comprises that:

the film (1) is arranged to enshroud the holder device (4) and with its first end (10) at a first end (12) of the holder device (4), wherein the first end (10) of the film (1) is seized with the seizer elements (2);

the seizer elements (2) are then moved essentially longitudinally of the holder device (4) towards its opposite end and completely or partially towards this end in such a manner that the film (1) is arranged in folds on the seizer elements (2);

the film is then secured by the seizer elements (2) and moved from the holder device (4) and across the dispenser device (8);

the folded film (1) is processed to bag-shape on its way, said film (1) being—at a point after the folds and opposite the first end of the film—welded and cut off, whereby a free and at least partially closed end (14) of the film (1) is formed, which closed end (14) is thus arranged opposite the first end of the film (1);

the seizer elements (2) are then released from the film (1), whereby the folded film (1) is left exteriorly on the dispenser device (8);

and the object (16) is then moved out of the dispenser device (8) towards the closed end (14) of the film (1) and the film (1) is gradually pulled off the dispenser device (8) and the object (16) is at least partially packaged therein.

3. A method according to claim 2, wherein the method is for packaging compressible objects (16), and wherein the dispenser device (8) expands the film (1) following receipt thereof, whereby the film (1), when pulled over the dispenser device (8), contracts around the object (16).

4. A method according to claim 2, wherein the method is used for successively packaging a series of objects (16) or a series of portions of objects (16), wherein the method comprises that, after a piece of film (1) has been folded and processed to bag-shape, a new first end (10) is formed in connection with the cutting off, said cutting off being accomplished in a position between the a holder means and the dispenser device (8).

5. A method according to claim 4, wherein the method comprises that the remaining film is pulled back across the holder means, whereby the new first end of the film (1) is arranged at the first end of the holder means.

6. A method according to claim 1, wherein the first end of the film is closed (14) following packaging of the objects (16), said closuring procedure comprising tightening by string or welding.

7. A system for packaging at least one object (16) in film (1), wherein the system comprises means for handling tubular film (1), an elongate holder device (4) configured for arrangement of a piece of film (1), at least two seizer elements (2) adapted cooperating with each other for seizing and handling film (1), means for welding and cutting (6) off film, and a dispenser device (8) configured for receiving and dispensing, respectively, a prepared piece of film (1), and means for moving the object (16) through the interior of the dispenser device (8), said seizer elements (2) being arranged for receiving and folding a piece of film (1), wherein the system is configured for a piece of film (1) to be configured with a number of folds and processed to bag-shape which is suitable for being arranged on the dispenser device (8); and wherein the system is configured for objects (16) to be packaged by being moved towards a bottom (14) of the bag-shaped film and gradually on in such a manner that the film will gradually be released from the dispenser device (8)

characterized by, that the seizer elements (2) are mounted to a travelling carriage (26) which, after releasing the bag-shaped film from the dispenser device (8), transfers the seizer elements (2) back to the holder device (4) where a subsequent tubular film is processed to a bag-shaped for a subsequent object.

8. A system according to claim 7, wherein the dispenser device (8) is configured to be able to expand a piece of film (1).

9. A system according to claim 7, wherein the expanse of the dispenser device (8) is shorter than the object or objects (16) to be wrapped.

10. A system according to claim 7, wherein a holder means are journalled on rollers (20) and configured such that the tubular film (1) is able to travel between the rollers (20) and the holder means for enshrouding the holder means.

11. A system according to claim 7, wherein the system comprises means for storing film on a roller supply, and is configured for film (1) to be advanced to a holder means, and wherein the film (1) is tubular either from the beginning or is continuously shaped and welded into tubular configuration during advancement to the holder means.

* * * * *